United States Patent [19]

Punater et al.

[11] Patent Number: 4,475,425

[45] Date of Patent: Oct. 9, 1984

[54] BLADE HOLDING DEVICE

[75] Inventors: Dineshchandra G. Punater, Dayton; John L. Herman, Huber Heights, both of Ohio

[73] Assignee: Harris Graphics Corporation, Melbourne, Fla.

[21] Appl. No.: 383,865

[22] Filed: Jun. 1, 1982

[51] Int. Cl.[3] ..... B26D 1/12

[52] U.S. Cl. ..... 83/700; 83/699; 83/674; 144/230; 407/49

[58] Field of Search ..... 83/660, 674, 698, 699, 83/700; 144/230; 407/41, 47, 49

[56] References Cited

U.S. PATENT DOCUMENTS

| | | | |
|---|---|---|---|
| 1,137,216 | 4/1915 | Klingborg | 144/230 |
| 2,832,411 | 4/1958 | Richards et al. | 164/66 |
| 2,842,233 | 7/1958 | Greenleaf | 407/49 X |
| 3,032,152 | 5/1962 | Titsler | 189/36 |
| 3,783,729 | 1/1974 | Parr | 83/666 |
| 3,793,918 | 2/1974 | Huffman | 83/674 |
| 3,924,318 | 12/1975 | Baker | 144/218 |
| 3,935,774 | 2/1976 | Craddy | 83/699 X |
| 4,131,047 | 12/1978 | Schriber et al. | 83/698 |
| 4,240,313 | 12/1980 | Gillespie | 83/674 |
| 4,331,056 | 5/1982 | Hombach et al. | 83/666 |
| 4,392,402 | 7/1983 | Rann | 83/699 X |

FOREIGN PATENT DOCUMENTS 2455864 7/1975 Fed. Rep. of Germany ..... 83/698

*Primary Examiner*—Donald R. Schran
*Assistant Examiner*—Taylor J. Ross
*Attorney, Agent, or Firm*—Biebel, French & Nauman

[57] ABSTRACT

A blade holding device is provided for use with a blade and a cylinder, the cylinder having a longitudinal recess defined in the periphery thereof parallel to the axis of the cylinder. First and second wedge members are fittable within the recess, each wedge member having an inner face and an outer face. A plurality of spring members is included, along with a resilient strip for holding the spring members in relative positions. The wedge members are insertable within the recess such that the resilient strip holding the spring members is disposed adjacent the outer face of the first wedge member. The blade is disposed between the resilient strip and a wall of the recess. Relative movement of the wedge members is performed by a bolt threadingly engaged with an end of the second wedge member and held in relative position with respect to the cylinder, whereby the blade is clamped between the first wedge member and the recess wall.

17 Claims, 9 Drawing Figures

BLADE HOLDING DEVICE

BACKGROUND OF THE INVENTION

The present invention relates to a device for mounting and accurately seating a perforating or cutoff blade along a cylinder such as might be used for partially or completely severing a web at a plurality of locations along its length. Such devices are particularly useful in machines for continuous printing or collating of paper webs.

One of the requirements for such blade mounting arrangements is that the cutting edge of a perforating blade be capable of accurate seating against an anvil surface. Otherwise, an uneven perforation will result, with some sections of the perforation being too deep, or some sections being too shallow, or both. This produces variation in the tear strength along the perforation, with resultant high probability of jamming in subsequent printers or bursters. A backup or anvil cylinder may be included for providing a hardened anvil surface, or insert, or in some cases a die, to cooperate with the sharpened edge of the properly seated blade in perforating the passing web as the web moves between the rotating blade cylinder and anvil or backup cylinder.

The blade is mounted to the rotating cylinder by clamping the blade into a recess or slot cut generally lengthwise into the cylinder periphery. The blade may be clamped against one of the side faces of the recess, or against an intermediate supporting bar. Several techniques are available, however, for providing proper seating of the cutting edge of the blade against the anvil surface.

Typically, when a perforating blade is manufactured, it includes some variation in height from its base to its cutting edge, as well as a tendency to bow in a vertical direction. One method for seating the blade is to use a blade which has been manufactured to very close tolerances with respect to both height and bow. The cylinder is provided with a recess that has been machined also to very close tolerances with respect to a uniform and specific depth. Seating of the blade is relatively simple, since the blade is loaded into the recess, with the base of the blade bottomed along the base of the recess, and is then clamped tightly in place.

Despite the simplicity of the seating process, this technique possesses several readily apparent disadvantages. By requiring very close tolerances in manufacturing of the blades, the cost of the blades is increased significantly. Similarly, the cost of the cylinder into which the recess is cut is also increased, particularly in view of the fact that such cylinders typically have as many as eight such recesses for mounting up to eight blades at one time. Moreover, in the event that blade height or recess depth varies even slightly from blade to blade or recess to recess, the cutting edge of a blade extending slightly further from the recess than another will be dulled relatively quickly through contact with the anvil surface.

A second technique is available, in which a blade having very loose height and bow tolerance may be used. The blade is inserted into the recess, but is not bottomed against the base of the recess, and is secured somewhat loosely along its length. The blade is then seated against the anvil surface, through a procedure known as "crash in". This procedure consists of rotating the blade cylinder and anvil cyliinder, with or without a web passing therebetween, at inching speed through one revolution. The cutting edge of the blade is free to move under the seating force sufficiently into the recess, at whatever locations are necessary to obtain a uniform seating of the cutting edge against the anvil. While secured somewhat loosely, the blade must be nonetheless held tight enough to hold its seated position. The apparatus is then stopped and the blade is securely clamped along its entire length to prevent slip within the recess when the apparatus is operated at higher speeds.

While this technique requires a more complicated blade seating technique, it allows the use of blades and cylinders manufactured to much looser tolerances, with substantial cost savings. A third technique, possessing some of the advantages and disadvantages of both techniques, utilizes a blade having close tolerance with respect to height only. While the blade is bottomed against the recess base, crash in is required to remove vertical bow from the blade.

It will be noted that the foregoing discussion is equally applicable in the case of cuttoff blades.

A number of various devices for accurately securing a blade within a recess, suitable for holding the blade both for crash in and for clamping, are known. For instance, the blade may be placed against a side wall of the recess, and a bar inserted into the recess adjacent the blade. A plurality of bolt members are threaded into holes in the bar, extending from the side of the bar to the recess side wall opposite the blade. To clamp the blade, the bolt members are driven in a direction outwardly from the bar against the recess wall. Driving of the bolt members forces the bar tightly against the blade, thereby clamping it in place. In using such a device, the bolt members may be partially tightened, allowing the blade limited movement for seating against the anvil surface during crash in, and then the bolt members may be completely tightened for clamping.

Several disadvantages are present in such a blade holding device. In order to provide relatively uniform clamping force on the blade, a relatively large number of the bolt members must be provided disposed along the length of the bar. Thus, the clamping operation becomes a time-consuming process. Furthermore, positioning of the bolt members for crash in must be fairly precise, since there is a relatively narrow force range suitable for crash in wherein the blade is held loosely enough for movement during seating but tight enough to retain the seated position. Furthermore, the bolt members also must be finally tightened to a relatively uniform degree, or uneven perforation will result where the blade is inadequately clamped. Consequently, during crash in and in clamping the blade, either a torque wrench must be used, or the operator must through experience develop a "feel" for the proper tightening of the bolt members.

In U.S. Pat. No. 2,832,411, issued Apr. 29, 1958, to Richards et al, another blade holding device is disclosed, for use in conjunction with a cylinder having a recess that is at an angle with respect to the axis of the cylinder. A pair of wedge bars, each extending for substantially the full length of the recess, are located within the recess with the blade inserted between the bars. The ends of the cylinder are provided with collars, each having a slot adjacent the recess, into which a bolt is fitted. The bolts each have a pair of flanges near the head, and when the bolts are placed into the slots, the flanges fit one on each side of the slot. Each bolt extends into a threaded bore in an end of one of the wedge bars, such that by rotating the bolts, each bar may be moved in either direction along the cylinder recess. To clamp the blade, the bolts are rotated such that the wedge bars are driven into the recess so as to wedge the blade into place. Notches or other indicia are provided along the upper surface of one of the wedge bars and the cylinder surface, so that the relative movement of the bar in relation to the cylinder for aligning the blade may be easily determined.

The Richards et al device reduces the number of bolts which must be manipulated during the clamping process in comparison with the single-bar device described above. It does not, however, address the problem of holding the blade for seating during crash in, and in fact, shows the blade bottomed on the recess base. Moreover, the Richards device possesses several disadvantages that make it impractical, particularly for use with a blade that must be seated for uniform perforation.

Because the force exerted upon the blade must be substantially uniform to ensure uniform perforation, the fit of the wedge bars into the recess must be very precise. Thus, very close tolerances must be provided in the widths of the wedge bars, recess, and blade, since variations in these dimensions will produce variations in the "tightness" of the fit of the wedge bars within the recess as the bars are wedged into place, thereby producing variations in the force applied to blade. As a result, not only is manufacture of the bars, recess and blade made difficult and expensive, but the slightest mishandling of these parts during use may be sufficient to misalign them to the extent that uniform force is no longer attainable.

Further, since the range of force values acceptable for crash in is relatively narrow, careful positioning of the bars is required prior to crash in. This requires the expenditure of significant amounts of time, use of special tools, and/or the development of special skills by the operator for proper adjustment of the bars.

What is needed, therefore, is a blade holding device for use with a cylinder in which the blade may be clamped in a relatively quick and simple manner. Such a device should require manipulation of few parts during the clamping operation, and should not require the use of any special tools or special skills on the part of the operator. The device should enable the blade to be secured loosely into the cylinder with uniform securing force, properly seated against an anvil surface, and then tightly clamped into place. Clamping force should be uniformly applied along the length of the blade. The device should be relatively simple to manufacture, and should not require unreasonably tight manufacturing tolerances.

SUMMARY OF THE INVENTION

The present invention provides a novel arrangement for clamping a blade to a rotary cutter cylinder. The blade is easily inserted into and held in place by the device such that the blade may move as necessary to seat against an anvil surface during crash in, the blade being held such that it will be retained in the seated position. Thereafter, the blade holding device can be tightened in order to secure the blade in the seated position.

The blade holding device of the present invention is for use in conjunction with a cylinder having a longitudinal recess defined in the periphery of the cylinder parallel to the cylinder axis. Included in the device are first and second wedge members that are fittable within the recess, each of the wedge members having an inner wedge face and an outer face. Each of the wedge members is tapered in a direction longitudinally along the recess. The wedge members are insertable within the recess such that the blade is disposed between the outer face of the first wedge member and one wall of the recess. One of the wedge members is moved relative to the other, such that the blade is wedged between the first wedge member and the recess wall. The blade is first secured sufficiently tight to allow seating of the blade against the anvil surface, the blade is seated during crash in, and then clamped securely.

To ensure uniform holding force against the blade for crash in, at least one spring member is provided such that the spring members may be disposed adjacent the outer face of the first wedge member between the wedge member and the blade. In a preferred embodiment, a plurality of spring members may be Belleville disc springs, although a spring member in the form of a corrugated metal strip or elastomeric strip, as well as other embodiments, may also be used. The disc springs may be held in relative positions, and the holding means may be a strip constructed of a resilient material having a plurality of holes along the length thereof. The disc springs are mounted one each within each hole. The first wedge member includes a relatively shallow channel defined along the length of its outer face, so that the resilient strip may be mounted along the channel whereby the disc springs may abut the perforating blade when the blade and first wedge member are inserted into the recess of the cylinder.

Inclusion of the spring member provides a wide range for relative positioning of the wedge members for crash in. Because the range of holding force exerted upon the blade for proper seating is relatively narrow, the spring members make application of the proper force easier, faster, and more precise than in previously known devices.

Spring members also allow a wider range of tolerance for the slot width, wedge member width and blade thickness, and produce more uniform crash in force along the entire length of the blade.

The relative movement of the wedge members within the cylinder recess may be performed by providing an end member mounted to one end of the cylinder adjacent the recess. The end member includes an opening therein, through which a bolt is extended. The bolt has at least one flange near its head, the flange being disposed on one side of the opening for retaining the bolt in a position relative to the end member. The bolt is further engageable with one of the wedge members, so that by rotating the bolt, the wedge member may be moved relative to the cylinder, and hence relative to the other wedge member.

The bolt may be engageable with an end of the second wedge member, and the relative movement of the wedge members is performed by moving the second wedge member along the recess. The first wedge member is captured between two end rings to prevent its movement along the recess. Additionally, at least a portion of the outer face of the first wedge member is roughened to increase the holding force on the blade or to prevent slippage of the blade within the recess.

Accordingly, it is an object of the present invention to provide a blade holding device for use with a perforating or cuttoff blade and a cylinder, wherein a pair of wedge members is provided with a means for effecting relative movement of the wedge members within a recess in the cylinder periphery to clamp the blade between one of the wedge members and a recess wall; to provide such a device wherein the blade may initially be secured sufficiently to allow seating against an anvil surface, and then clamped to secure the blade for perforation of a web; to provide such a device which exerts a uniform crash in or clamping force along the entire length of the blade; to provide such a device which is relatively quick and simple to operate; and to provide such a device which is relatively easy to manufacture.

Other objects and advantages will be apparent from the following description, the accompanying drawings and the appended claims.

DETAILED DESCRIPTION OF THE PREFERRED EMBODIMENTS

Figure 1:
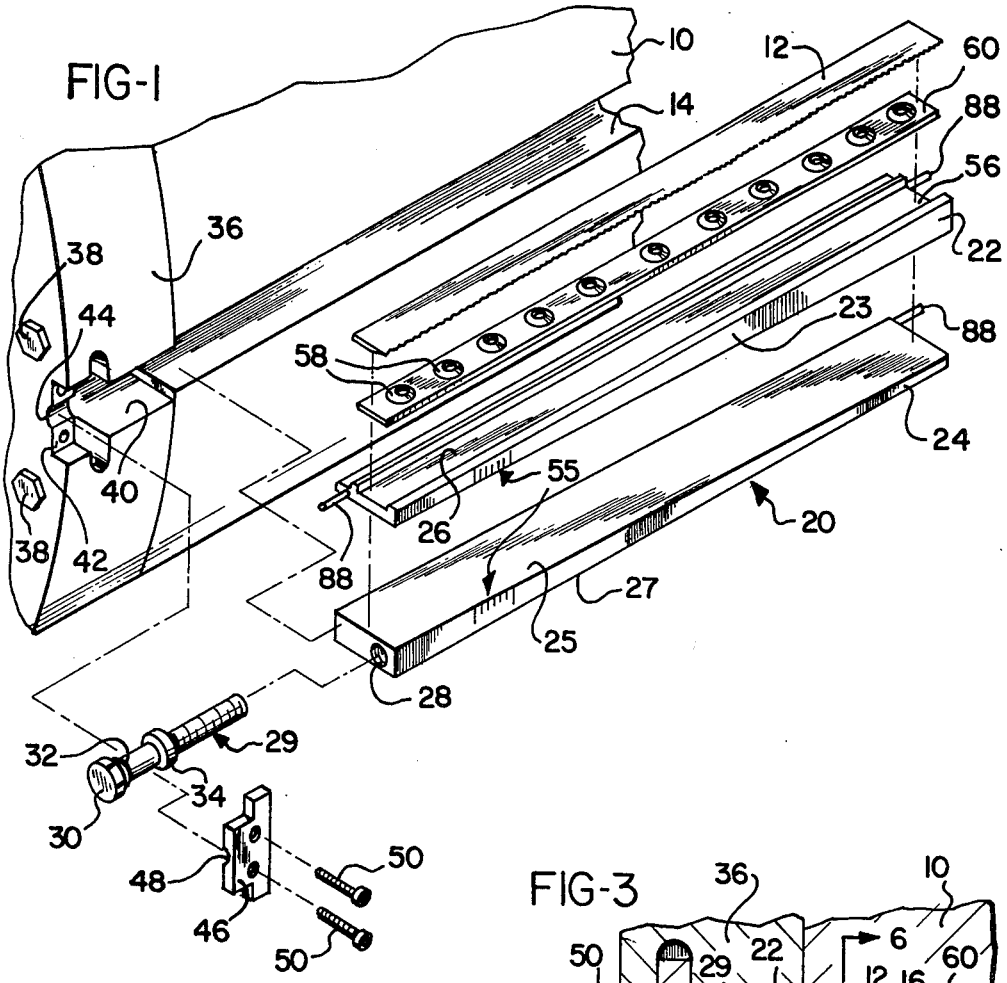
FIG. 1 is a perspective view of a portion of a rotary cutter cylinder showing insertion into a recess therein of a blade and the blade holding device of the present invention.
Figure 6:
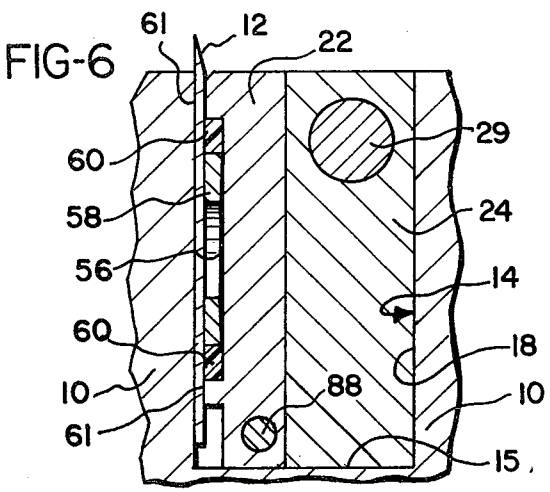
FIG. 6 is an enlarged cross-sectional view of a segment of the cylinder, taken generally along line 6—6 of FIG. 3.

FIG. 1 shows a portion of a typical rotary cutter cylinder 10 to which may be mounted a blade 12. Blade 12 is shown as a perforating blade, but may be a cutoff blade as well. The cylinder 10 includes a longitudinal recess 14 defined along the periphery of cylinder 10. Recess 14 is preferably rectangular in cross-section, and as seen in FIG. 6, includes a base 15 and opposed walls 16 and 18. Referring back to FIG. 1, blade 12 may be inserted into recess 14 of cylinder 10 for mounting, although blade 12 is not bottomed against base 15, allowing space both for crash in and storage of blade 12 when not in use. Blade 12 is held in position by the blade holding device 20 of the present invention.

Figure 2:
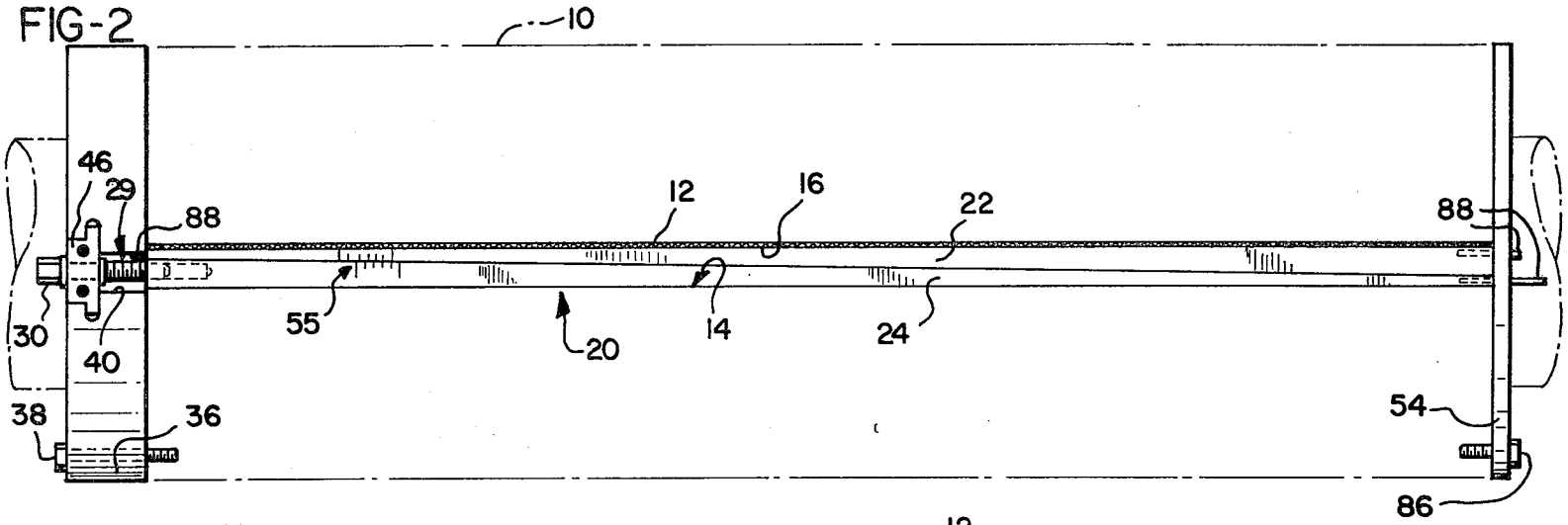
FIG. 2 is a plan veiw of the cylinder showing the blade and blade holding device in position.

Blade holding device 20 includes a pair of wedge members 22 and 24. Each wedge member 22 and 24 has an inner wedge face 23 and 25, respectively, and an outer face 26 and 27, respectively. As may be seen in FIG. 2, wedge members 22 and 24 are tapered in a direction longitudinally along the recess 14. Further, wedge members 22 and 24 are insertable into recess 14 of cylinder 10 with wedge faces 23 and 25 in mutual contact, such that the blade 12 may be held between outer face 26 of wedge member 22 and wall 16 of recess 14. Wedge member 24 is moved relative to wedge member 22, applying a wedging force against both walls 16 and 18 of recess 14, thereby clamping blade 12 into position.

Figure 3:
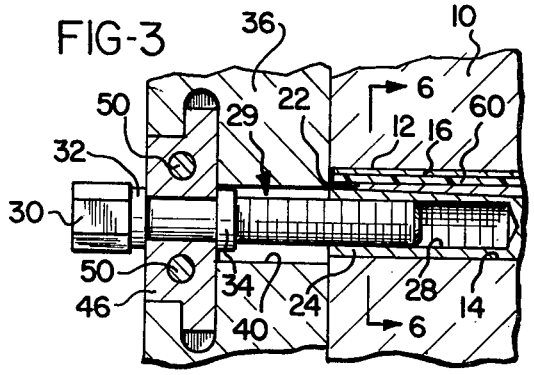
FIG. 3 is a sectional view of a portion of one end of the cylinder, showing the wedging mechanism for operating the blade holding device with the blade firmly clamped in place.
Figure 4:
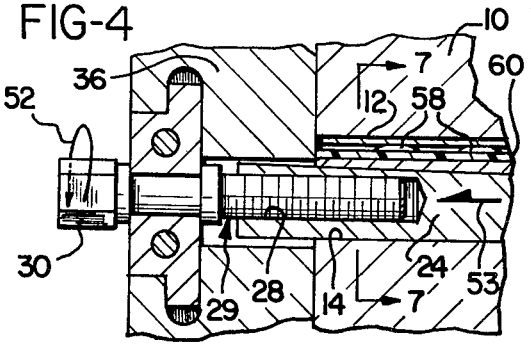
FIG. 4 is a view similar to FIG. 3 showing the operation of the wedging mechanism and with the blade in position for seating within the recess.

The means for effecting movement of wedge member 24 with respect to wedge member 22 may be seen in FIGS. 1, 3 and 4. Wedge member 24 is provided with a threaded bore 28 in one end thereof. Bolt 29, engageable with bore 28 includes a head 30 and a pair of flanges 32 and 34. An annular collar 36 attached to one end of cylinder 10 by a plurality of bolts 38 includes notch 40, communicating with recess 14 of cylinder 10. When wedge member 24 is inserted into recess 14, and bolt 29 is threaded into bore 28, notch 40 provides for extension of head 30 of bolt 29 beyond collar 36, so as to allow manipulation of bolt 29 from a position adjacent one end of cylinder 10.

Notch 40 of collar 36 includes a relatively shallow portion 42 having a groove 44 defined therein. A retaining member 46, having a groove 48, is mounted to relatively shallow portion 42 by a pair of bolts 50. Grooves 44 and 48 cooperate to define a hole, and bolt 29 is fittable within the hole such that flanges 32 and 34 are disposed on each side of the hole. Grooves 44 and 48 are sized accordingly such that flanges 32 and 34 retain bolt 29 within the hole, but bolt 29 is freely rotatable within the hole.

In the alternative, of course, it will be recognized that bolt 29 may have a single flange, with the single flange and bolt head 30 cooperating at opposite ends of grooves 44 and 48 for retention of bolt 29 within the hole defined by grooves 44 and 48.

The operation of bolt 29 for moving wedge member 24 relative to wedge member 22 may be seen by comparing FIGS. 3 and 4. FIG. 3 illustrates the wedge members 22 and 24 wedged into recess 14 of cylinder 10 such that blade 12 is securely held between outer face 26 of wedge member 22 and wall 16 of slot 14. To release blade 12, head 30 of bolt 29 is gripped by an appropriate tool (not shown) and bolt 29 is rotated in the direction indicated by arrow 52 in FIG. 4. It will be noted from arrow 52 that bolt 29 and bore 28 are provided with left-handed threads, and bolt 29 may have multiple start threads for faster movement of bolt 29 along bore 28, and hence, faster operation of the blade holding device 20. By rotating within threaded bore 28 of wedge member 24, bolt 29 draws wedge member 24 in a direction toward collar 36, as indicated by arrow 53. As wedge member 24 is drawn toward collar 36, wedge members 22 and 24 no longer apply wedging force to the walls of recess 14, and blade 12 is released and may be removed.

It will be recognized that to move wedge member 24 for clamping blade 12 into recess 14, the opposite of the operation described above is performed. Bolt 29 is rotated in a direction opposite to that indicated by arrow 52, thereby moving wedge member 24 away from bolt 29. Wedge members 22 and 24 apply a wedging force to the walls of recess 14, clamping blade 12 into place.

During either of these operations, wedge member 22 remains stationary within recess 14, retained by collar 36 and an annular end ring 54 mounted to the opposite end of cylinder 10 from collar 36.

It can easily be seen that the force or load applied to blade 12 by blade holding device 20 is dependent upon compression of wedge members 22 and 24 across recess 14, which in turn is dependent upon the displacement of wedge member 24 along recess 14. Accordingly, as an aid to the operator of the device 20 in positioning wedge member 24 relative to wedge member 22, which remains stationary, each wedge member is provided with marks, notches or other indicia 55 to present a visual indication of their relative movement.

To faciliate the movement of wedge member 24 relative to and in contact with wedge member 22 and recess 14, any appropriate solid lubricant may be applied to the wedge face 25 and outer face 27 of wedge member 24.

During crash in of blade 12 for proper seating within recess 14 to provide a uniform perforation or severing of a web passing along cylinder 10, force must be applied to blade 12 by the blade holding device 20 within a relatively narrow range of forces so that blade 12 is held loosely enough to permit seating, yet tightly enough to retain the seated position prior to final clamping. In order to expand the range of positions of wedge member 24 relative to wedge member 22 and recess 14 wherein force within the crash in range is applied to blade 12, a relatively shallow channel 56 is defined along the length of the outer face 26 of wedge member 22, as seen in FIG. 1. A plurality of Belleville disc springs 58 are disposed along channel 56, and are held in relative position by a rubber strip 60. Rubber strip 60 includes a plurality of holes defined along its length, such that each spring 58 may be mounted within one of the holes and retained thereby. Springs 58 may be held into the holes of strip 60 either by cementing them in place, such as with a rubber cement, or molding the strip 60 about the springs 58 so that they are retained in place. Strip 60 is preferably mounted to channel 56 by a rubber cement material.

Figure 7:
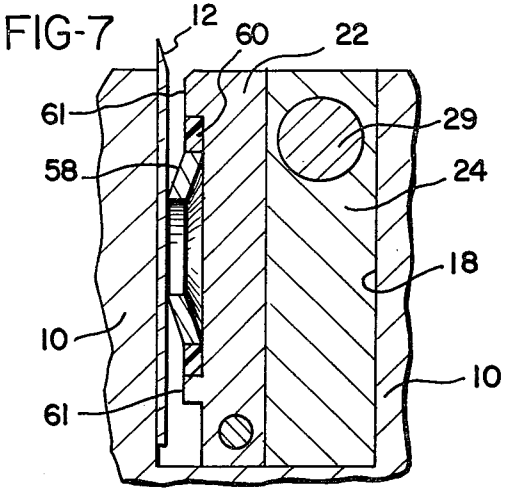
FIG. 7 is a view similar to FIG. 6, taken generally along line 7—7 of FIG. 4.

As seen in FIGS. 6 and 7, during clamping of blade 12, springs 58, held in place by strip 60, are gradually compressed against blade 12 as wedge member 24 is wedged into recess 14. Once springs 58 are compressed to the point at which surfaces 61 of wedge member 22 are in contact with blade 12, however, further movement of wedge member 24 results in blade 12 being clamped essentially by the wedge members 22 and 24 directly.

Surfaces 61 may be roughened or knurled to provide increased holding force, by friction, for the blade 12 to prevent its slippage within recess 14.

Figure 5:
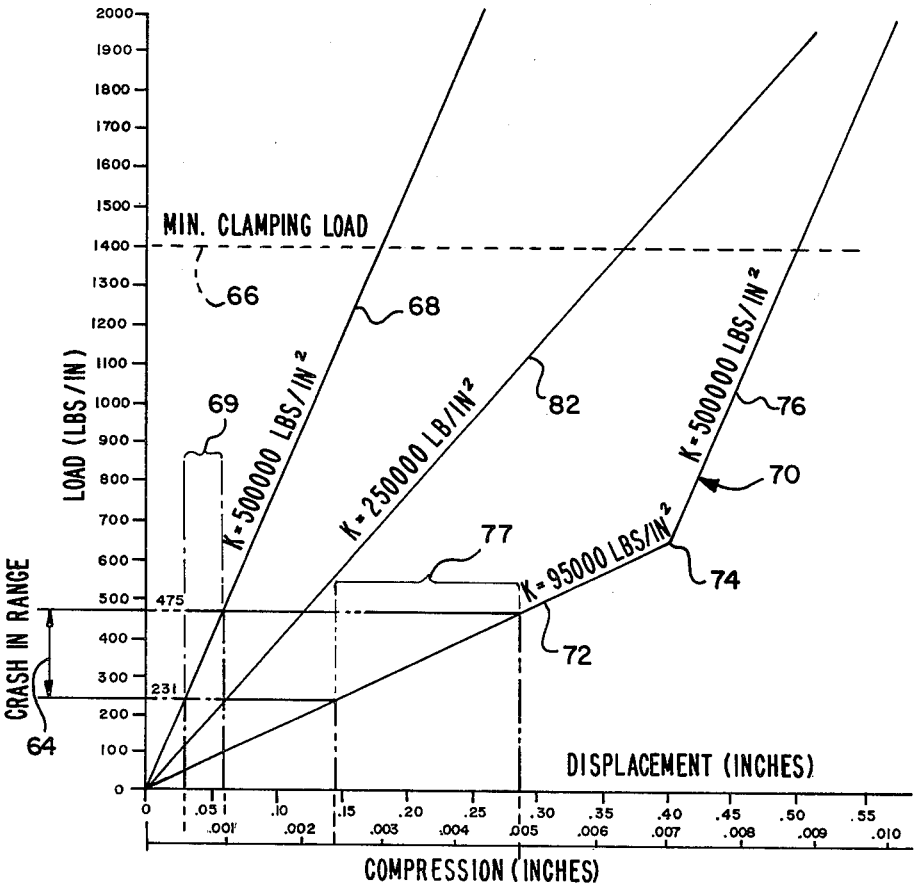
FIG. 5 is a graph showing the load applied to the perforating blade as a function of displacement of a wedge member along the recess, and as a function of the compression of the wedge members and spring members across the recess.

The operation of springs 58 for providing relative ease in positioning wedge member 24 for crash in of blade 12 may be seen by referring to FIG. 5, showing a plot of the load (force per unit length) placed upon the blade 12 by the blade holding device 20 as a function of the displacement of wedge member 24 along recess 14, and as a function of the compression of wedge members 22 and 24 and springs 58 across recess 14. It will be recognized that the values presented along the load axis of FIG. 5 are pertinent to blades and blade holding devices in general, independent of their length, and values presented along the compression axis are similarly independent of the angle formed between the wedge face 25 and outer face 27 of the wedge member 24. Values presented along the displacement axis of FIG. 5, however, are dependent upon the wedge member angle, and specific values in FIG. 5 are based upon an exemplary angle of 1°. It will be nonetheless understood that the shapes and relationships of the curves presented are correct for any angle.

It has been found experimentally that the proper load to be placed upon blade 12 for satisfactory crash in is within the approximate range of 231 to 475 lbs./in., indicated in FIG. 5 by arrow 64. For final clamping of blade 12, a load of at least 1400 lbs./in. must be applied, indicated at 66.

In the absence of springs 58, the load produced by deflection of wedge member 24, corresponding to direct compression of wedge members 22 and 24, follows the linear Hooke's law relationship for compression of an elastic body, with wedge members 22 and 24 having an effective force constant of 50,000 lbs./in.$^2$, and is shown as curve 68 of FIG. 5. For crash in, wedge member 24 must be moved between approximately 0.03 and 0.06 inches to produce a load on blade 12 within the appropriate range. It can easily be seen, however, that positioning of wedge member 24 must necessarily be relatively precise, i.e., to within a range of 0.03 inch, in order to achieve the proper crash in load. With such a small range, even indicia 55 are of relatively little help for proper positioning. Thus, special tools for adjusting bolt 29 must be used, or the operator of the device 20 must develop special skills or expertise.

When springs 58 are provided as illustrated generally in FIG. 1, the displacement of wedge member 24 produces the load values indicated by curve 70 in FIG. 5. Initially, only springs 58 actually contact blade 12, as seen in FIG. 7, and as wedge member 24 is moved, springs 58 compress against blade 12. Springs 58 have a significantly lower force constant (or, more properly here, a spring constant), approximately 95,000 lbs./in.$^2$, than wedge members 22 and 24, and the initial portion of curve 70, indicated at 72, has a proportionately reduced slope.

Once springs 58 are compressed such that surfaces 61 of wedge member 22 contact blade 12, indicated at point 74 on curve 70, further displacement of wedge member 24 causes increases in the load on blade 12 to be applied by wedge members 22 and 24 directly. Accordingly, the final portion 76 of curve 70 is of the same slope as curve 68.

The effect of springs 58 upon the operation of blade holding device 20 for applying crash in force of blade 12 may be appreciated by considering the crash in load range 64. To apply the proper load, wedge member 24 must be moved between approximately 0.14 and 0.28 inches, or within a range of 0.14 inch, as indicated at 77. Thus, a relatively broad range of positions is available for wedge member 24, making the use of indicia 54 much more practical and helpful. Since positioning of wedge member 24 is no longer so critical, no special tools or operator expertise is required for operating blade holding device 20.

After springs 58 are compressed such that surfaces 61 of wedge member 22 contact blade 12, further displacement of wedge member 24 causes the load to increase as shown by portion 76 of curve 70. Since portion 76 has a significantly increased slope compared to portion 72, relatively little additional displacement is necessary to apply the final clamping load to blade 12.

An additional, if not more important, advantage may be obtained through use of the spring members as provided in any of the embodiments disclosed above. In the absence of spring members, very close tolerances must be provided to insure the uniformity of the widths of the wedge members 22 and 24, the recess 14, and blade 12, with the attendant high cost and extreme care required in handling these parts. Otherwise, because of the relative rigidity of wedge members 22 and 24, variation in these dimensions may produce areas along blade 12 of varying load exerted thereon, resulting in uneven perforation or severing of the web. The required tolerance may be seen from FIG. 5. The compression range within the crash in range where wedge members 22 and 24 are used without springs 58, shown on curve 68 as range 69, is between 0.0005 and 0.0010 inch. If the tolerance on any one or a combination of wedge members, blade or recess is such that any area along blade 12 is compressed outside this range, load applied will be outside the crash in range, seating may not be accurate, and the resulting perforation or severing may be uneven. Thus, the tolerance required is 0.0010 inch−0.0005 inch=0.0005 inch.

Due to the relative flexibility imparted to the blade holding device 20 by inclusion of one or more spring members, however, these tolerances may be relaxed. As shown at 77 along curve 70 of FIG. 5, when springs 58 are used, the compression range of wedge members and springs is between 0.0024 and 0.0050 inch. Thus, inclusion of springs 58 allows wedge member, blade and recess tolerance to be increased to 0.0026 inch, a five-fold increase, with resulting significant cost savings in manufacture.

Figure 8:
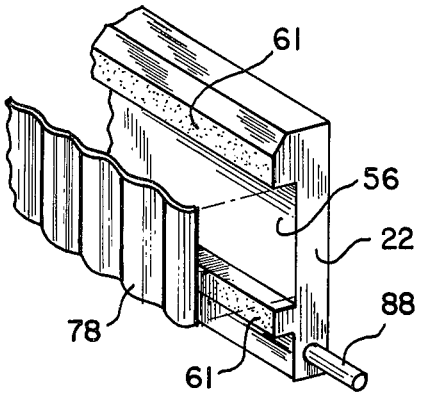
FIG. 8 is a perspective view of a portion of a wedge member, showing an alternative embodiment for the spring member.
Figure 9:
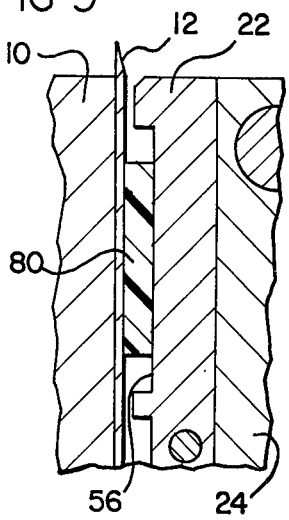
FIG. 9 is a cross-sectional view similar to a portion of FIG. 6, showing a further alternative embodiment for the spring member.

A number of alternative embodiments for the spring members may be used in place of springs 58 and rubber strip 60, each having the same operation as the embodiment just disclosed and producing a load-displacement curve of the same shape as curve 70. In FIG. 8, a single corrugated metal strip 78 is provided, fittable within channel 56 of wedge member 22. In FIG. 9, a continuous elastomeric strip 80 is used, mounted to channel 56 by a rubber cement material. A series of slightly compressible rollers or balls may be placed between the wedge members 22 and 24. Of course, it will be recognized that numerous other alternatives exist and may be used as well.

It will also be recognized that spring members may be used that are characterized by a non-linear compression-load relationship. Such an embodiment will produce a curve somewhat different from curve 70, in that the portion corresponding to portion 72 will not be linear, but will nonetheless result in expansion of the compression and displacement ranges for crash in, thereby obtaining the same advantages.

A still further alternative embodiment may be used in which the spring members are effectively "built-in" within wedge members 22 and 24. Either of wedge members 22 or 24, or both, may be provided with portions formed of a weaker steel or other metal, or may be provided with one or more cut-out sections along the length of wedge member 22 or 24, the cut-out sections being formed so that wedge member 22 or 24 remains as a unitary piece. The effect of providing weakened portions or cut-out sections is to reduce the force constant of wedge members 22 and 24, with the result shown as curve 82 in FIG. 5. Such an embodiment produces advantages approximately midway between those obtained through the wedge members with separate spring members and the wedge members alone. It may be seen that the displacement range available for crash in is greater than for the wedge members alone, although it is not as great as when distinct spring members are provided. Total displacement for final clamping, however, is less than that required in the separate spring members embodiments, respresenting some savings in time used for manipulating bolt 29.

In a similar alternative, weakened or cut-out portions may be included along the side walls of recess 14, particularly wall 18.

It will be recognized further that spring members such as springs 58 may be used, and the advantages thereof obtained, with embodiments for clamping a blade with one or more wedge members other than the preferred, two wedge-member embodiment disclosed herein. For example, in one alternative embodiment, a wedge member is provided having a taper in a direction radial with respect to the cylinder. The recess is cut to cooperate with the wedge member such that movement of the wedge member within the recess toward or away from the cylinder axis clamps or unclamps the blade. See, for example, U.S. Pat. No. 4,131,047, issued Dec. 26, 1978, to Schriber et al. In such a case, the springs are provided between the wedge member and the blade, although a buffer plate may also be provided therebetween for facilitating retention of the springs and/or blade in position.

It is common practice to rotate the cylinder 10 on occasions when it is desired not to perforate or sever the web. In such a case, the blade holding device 20 is unclamped, blade 12 is bottomed against recess blade 15 so that the cutting edge of blade 12 is below the surface of cylinder 10, and the device 20 is reclamped. In the event device 20 is inadvertently left unclamped, however, a means for retaining wedge members 22 and 24 within recess 14 when unclamped is provided. In addition to collar 36 mounted to one end of cylinder 10, an annular ring 54 is provided at the opposite end, seen in FIG. 2. Ring 54 is attached to cylinder 10 by a plurality of screws 86 (only one shown) and is of a radial width less than the depth of recess 14. A retaining pin 88 is mounted near the lower end of each of wedge members 22 and 24, such that when wedge members 22 and 24 are inserted into recess 14, retaining pins 88 extend from recess 14 under the ring 54. When cylinder 10 is rotated with wedge members 22 and 24 unclamped, retaining pins 88 cooperate with ring 54 to hold the wedge members in place. A similar retaining pin 88 is provided at the opposite end of wedge member 22, and in inserted into a half-slot (not shown) defined within collar 36. It will be seen that no retaining pin is required for the opposite end of wedge member 24, due to its engagement with bolt 29.

While the form of apparatus herein described constitutes a preferred embodiment of this invention, it is to be understood that the invention is not limited to this precise form of apparatus, and that changes may be made therein without departing from the scope of the invention.

What is claimed is:

1. A blade holding device for use with a blade and a cylinder, the cylinder having a longitudinal recess defined in the periphery thereof parallel to the axis of the cylinder, comprising:

at least one wedge member fittable within the recess, said wedge member having an inner face and an outer face, said wedge member being operative in response to movement thereof relative to the recess for wedging said wedge member within the recess;

at least one spring member;

said wedge member being insertable within the recess such that the blade is disposed between said outer face and a wall of the recess and said spring member is disposed between one of said faces and a wall of the recess; and means for performing movement of said wedge member relative to the recess whereby the blade is clamped between said wedge member and the recess wall.

2. A blade holding device for use with a blade and a cylinder, the cylinder having a longitudinal recess defined in the periphery thereof parallel to the axis of the cylinder, comprising:

first and second wedge members fittable within the recess, each said wedge member having an inner wedge face and an outer face, each of said wedge members being tapered in a direction longitudinally along said recess;

at least one spring member;

said wedge members being insertable within the recess such that said spring member is disposed adjacent said outer face of said first wedge member, the blade being disposed between said spring member and a wall of the recess; and means for performing relative movement of said wedge members whereby the blade is clamped between said first wedge member and the recess wall.

3. A blade holding device as defined in claim 2 further comprising means for retaining said spring member in a position relative to said first wedge member.

4. A blade holding device as defined in claim 3 wherein said means for retaining said spring member includes a relatively shallow channel along the length of said outer face of said first wedge member, said spring member being insertable within said channel.

5. A blade holding device as defined in claim 2 wherein said spring member is a corrugated metal strip.

6. A blade holding device as defined in claim 2 wherein said spring member is a strip of an elastomeric material.

7. A blade holding device as defined in claim 2 wherein said spring member is defined by at least one of said wedge members, said wedge member having at least one portion removed therefrom.

8. A blade holding device for use with a blade and a cylinder, the cylinder having a longitudinal recess defined in the periphery thereof parallel to the axis of the cylinder, comprising:

first and second wedge members fittable within the recess, each said wedge member having an inner wedge face and an outer face, each of said wedge members being tapered in a direction longitudinally along said recess;

a plurality of spring members;

means for holding said spring members in relative positions;

said wedge members being insertable within the recess such that said spring holding means is disposed adjacent said outer face of said first wedge member, the blade being disposed between said spring holding means and a wall of the recess; and means for performing relative movement of said wedge members whereby the blade is clamped between said first wedge member and the recess wall.

9. A blade holding device as defined in claim 8, wherein said spring members are Belleville disc springs.

10. A blade holding device as defined in claim 9, wherein said spring holding means includes a strip constructed of a resilient material having a plurality of holes defined along the length thereof, one of said disc springs being mounted within each said hole.

11. A blade holding device as defined in claim 10, wherein said first wedge member includes a relatively shallow channel along the length of said outer face thereof, said resilient strip being mounted along said channel such that said disc springs abut the perforating blade when said first wedge member is inserted into the recess of the cylinder.

12. A blade holding device as defined in claims 2 or 8, wherein said means for performing relative movement of said wedge members includes a collar member mounted to one end of the cylinder adjacent the recess and having an opening defined therethrough, a bolt engageable with an end of one of said wedge members and extending through said opening, said bolt having at least one flange near the head thereof, said flange being disposed on one side of said opening for retaining said bolt in a position relative to said collar member to effect relative movement of said wedge members.

13. A blade holding device as claimed in claim 12, wherein said bolt is engageable with an end of said second wedge member.

14. A blade holding device as defined in claim 11, wherein the relative movement of said wedge members is performed by moving said second wedge member along said recess.

15. A blade holding device for use with a blade and a cylinder, the cylinder having a longitudinal recess defined in the periphery thereof parallel to the axis of the cylinder, comprising:

at least one wedge member fittable within the recess, said wedge member having an inner face and an outer face, said wedge member being insertable within the recess such that the blade is disposed between said outer face and a wall of the recess;

means for performing movement of said wedge member relative to the recess, said wedge member being operative in response to movement thereof for applying force to the blade for retaining the blade within the recess; and means for increasing said retaining force applied to the blade as a variable function of movement of said wedge member said means for increasing said retaining force includes;

means for increasing said retaining force applied to the blade as a first function of said movement of said wedge member up to a specific force value; and means for increasing said retaining force applied to the blade beyond said specific force value as a second linear function of said movement of said wedge member.

16. A blade holding device as defined in claim 15 wherein said means for increasing said force according to said first linear relationship includes at least one spring member disposed between the blade and said wedge member for compression by said wedge member against said blade, said specific force value being defined by means for limiting compression of said spring member, and said means for increasing said force according to said second linear relationship includes means enabling said wedge member to contact the blade once compession of said spring member is limited by said compression limiting means.

17. A blade holding device as defined in claim 16 wherein said compression limiting means and said means enabling said wedge member to contact the blade include a relatively shallow channel defined along the length of said outer face of said wedge member, said spring member being disposed within said channel.

* * * * *